United States Patent [19]

Binasik et al.

[11] 4,387,654

[45] Jun. 14, 1983

[54] METHOD FOR FIRING A ROTARY KILN WITH PULVERIZED SOLID FUEL

[75] Inventors: Chester S. Binasik, Palo Alto; Louis D. Siegert, Burlingame, both of Calif.

[73] Assignee: Coen Company, Inc., Burlingame, Calif.

[21] Appl. No.: 298,825

[22] Filed: Sep. 2, 1981

Related U.S. Application Data

[62] Division of Ser. No. 146,810, May 5, 1980, Pat. No. 4,310,299.

[51] Int. Cl.[3] ..... F23D 1/00

[52] U.S. Cl. ..... 110/347; 432/14; 110/106; 110/261; 110/265

[58] Field of Search ..... 110/106, 347, 263, 265; 432/105, 106, 103, 14

[56] References Cited

U.S. PATENT DOCUMENTS

| | | | |
|---|---|---|---|
| 2,971,480 | 2/1961 | Sage | 110/265 |
| 3,043,525 | 7/1962 | Gilbert | 110/106 |
| 4,090,455 | 5/1978 | McCartney | 110/106 |
| 4,132,180 | 1/1979 | Fredrick | 110/265 |
| 4,206,712 | 6/1980 | Vatsky | 110/261 |
| 4,223,615 | 9/1980 | Breen et al. | 110/347 |
| 4,246,853 | 1/1981 | Mehta | 110/347 |
| 4,263,856 | 4/1981 | Rickard | 110/347 |
| 4,270,466 | 6/1981 | Ansen et al. | 110/347 |
| 4,276,835 | 7/1981 | Zeltner | 110/347 |
| 4,280,418 | 7/1981 | Erhard | 110/347 |
| 4,294,178 | 10/1981 | Borio et al. | 110/347 |
| 4,300,480 | 11/1981 | Schoppe et al. | 110/347 |
| 4,310,298 | 1/1982 | Abelitis | 110/347 |
| 4,316,420 | 2/1982 | Kochy | 110/347 |

*Primary Examiner*—Henry C. Yuen

*Attorney, Agent, or Firm*—Townsend and Townsend

[57] ABSTRACT

Disclosed is a method for firing a kiln as well as a method for producing cement clinker in which pulverized coal is initially entrained in an airflow of about 2% of the theoretical amount of air needed to combust the coal and transport it to a burner. Supplemental primary air heated sufficiently to vaporize volatiles in the coal is mixed with the coal flow in a burner, discharged into the kiln and hence ignited. Secondary combustion air heated to between 800° F. to 1650° F. and more is added in the kiln to effect the substantially complete combustion of the pulverized coal in the kiln.

15 Claims, 4 Drawing Figures

METHOD FOR FIRING A ROTARY KILN WITH PULVERIZED SOLID FUEL

This is a division of application Ser. No. 146,810, filed May 5, 1980 now U.S. Pat. No. 4,310,299.

BACKGROUND OF THE INVENTION

A variety of bulk products, primarily cement but others too, must be subjected to high temperatures during a stage of their manufacturing process. Cement ordinarily is produced by burning calcareous and argillaceous and other raw materials in a cement kiln to produce an interim stage called clinker. The clinker is later pulverized to form cement powder. The drying kiln ordinarily comprises a large rotating cylinder which is between 200 and 500 ft. long, and which is inclined slightly from horizontal. Raw materials are injected into one end of the cylinder, flows slowly downwardly through it and is agitated as it flows by the rotation of the cylinder. A burner projects a flame down the center of the cylinder to process the raw materials into clinker. From the discharge end the hot product drops gravitationally into a high temperature cooler for further processing.

The necessary heat is generated by one or more burners positioned within the discharge end of the rotary kiln. In the past these burners were usually gas or oil fired burners because of their ease of operation. With the ever increasing costs of such fuels and their increasing scarcity, they have become unattractive and such gas and oil burners are being converted into solid fuel, e.g. coal burners at an increasing rate because solid fuels are available at substantially lower costs.

The burners must be arranged so that the flame extends over a substantial distance, say from a minimum of 10 or 15 ft. to as much as 50–80 ft. or more from the discharge end into the kiln to heat the raw materials sufficiently to convert them into the desired product. The fuel itself is combusted in the kiln above the product carried therein. For gaseous and liquid fuels this presents no problem. For solid fuels, e.g. coal, it is necessary to first pulverize the coal so that it can be discharged from the burner into the kiln in the form of fine particles for combustion therein.

To accomplish this it has heretofore been common practice to pulverize the coal in a mill and entrain the coal in an airflow to convey the pulverized coal directly to the burner. Coal pulverizing mills require a significant amount of air and it was common to use the same air both for conveying the coal to the burner and as a source of primary combustion air.

Such a direct firing of the coal has several disadvantages. First, the coal mills typically require up to 45% of the combustion air depending on the coal. This is a relatively constant amount of air irrespective of the rate at which coal is pulverized. Thus, the coal to air ratio coming out of the mill is different to control when the burner load is changed and this complicates the necessary controls or contributes to combustion inefficiencies. Further, the air is moisture-laden, which increases with the moisture content of the coal. This adversely affects the combustion process and the maximum temperature that can be attained in the kiln. Accordingly, since this air is relatively cold such burners, when used for a process such as cement manufacturing have a low efficiency and are difficult to regulate.

To overcome these shortcomings an indicrect firing system has heretofore been devised. In this approach, the coal is again pulverized in the mill but is then separated from the air required by the mill in a cyclone separator or the like. The air, after appropriate filtration is discharged while the coal is stored in a bin or storage container from which it can be withdrawn irrespective of the rate at which the coal is pulverized.

The pulverized coal from the bin is entrained in a coal conveying airstream at the desired rate. The stream transports the coal to the burner and normally constitutes the burner's source of primary combustion air.

This arrangement has several advantages over the direct firing system. For one, the coal and air feed rates are independent of the coal pulverizing mill. Secondly, the air used in the pulverizing mill and the moisture transferred to it from the coal as it is being pulverized are discharged so as to not adversely affect the combustion of the coal in the kiln and reduce the flame temperature. Nevertheless, this simple indirect firing system has several disadvantages, the most serious one being the difficulty of igniting and maintaining a flame because of the relatively low temperature of the coal being discharged by the burner and the relatively high volume of air employed to convey the coal to the burner, the latter constituting up to about 20% of the theoretical amount of air needed to combust the coal in the kiln. Other disadvantages experienced with this system are the large conduits that are necessary for conveying the relatively large air volume in which the coal is entrained to the burner, the resulting large size of the burner, etc. which made the overall installation not only expensive but more difficult to maintain.

Attempts have also been made to add to the pulverized coal-airstream additional and heated, supplemental primary air so as to raise the temperature of the stream in the burner to thereby facilitate the combustion of the coal in the kiln and raise the flame temperature. Although such attempts were marginally helpful, ignition difficulties persisted primarily because it was not practicable to add a sufficient amount of heated supplemental air to raise the temperature of the coal to a point where volatiles are driven off, i.e. vaporized so that they can later be flash-ignited, which would help bring the temperature of the non-volatiles in the coal to their flash-point.

A by-product of the ignition difficulties experienced in the past is that it was heretofore not feasible to use solid fuels having no or only a low content of volatiles, such as petroleum coke, which comprises almost exclusively carbon, because the necessary ignition temperature could not be reached with pulverized coal burners heretofore available. Yet, such low volatile solid fuels constitute a readily available, low cost source of energy and they would otherwise be ideally suited for use in kilns of the type here under consideration.

SUMMARY OF THE INVENTION

The present invention seeks to overcome the heretofore encountered shortcomings displayed by solid fuel burners utilized in rotary kilns by raising the temperature of the coal as well as of the combustion air before their discharge into the kiln to a level where the vaporization of volatiles occurs. This is accomplished with heat recovered from the kiln which would otherwise consitute wasted energy. Thus, the heating of both the pulverized coal and the combustion air is essentially "free".

Broadly speaking, the present invention accomplishes this by indirect firing the kiln burner with pulverized coal, that is by withdrawing the coal at the desired rate from a storage bin as was heretofore practised. However, the coal is entrained in a coal conveying primary combustion airstream which comprises no more than about 5% and preferably between about ½% to 2% of the theoretical amount of air needed to combust the coal in the kiln (hereinafter sometimes "theoretical air") instead of the up to 45% combustion air with which pulverized coal was often conveyed to the burner in the past. Before the coal issues from the burner, a second or supplemental stream of primary air is added thereto.

The supplemental air is selected so that the total primary air amounts to no more than about 20% and preferably to no more than about 10% of the theoretical air. Further, the supplemental primary air is heated to a temperature so that the temperature of the coal is elevated sufficiently to effect a vaporization of volatiles in the coal preparatory to the injection of the pulverized coal-airstream into the kiln.

In this manner, the vaporized volatiles of the coal ignite substantially instantaneously upon issuing from the burner which rapidly heats the other combustible constituents of the coal (mostly carbon) to their ignition temperature. As a result, a steady flame of the desired high temperature is assured.

For normal operating condition, the supplemental primary air has a temperature of at least about 400° F. and it preferably is in the range of between about 600°–750° F. although the temperature may be as high as 1500° F. The upper limit is primarily dictated by the availability of equipment, e.g. fans, for handling such high temperature air.

This results in several distinct advantages. First, the flow rates of both the pulverized coal and the coal transport air can be closely and relatively easily regulated to correspond to the heat required in the kiln, and the airflow rate can be reduced in the same proportion in which the coal flow rate is reduced. Secondly, the vaporization of volatiles within the burner assures an instantaneous ignition of the volatiles upon discharge from the burner and a substantially instantaneous heating of the non-volatiles so that they can be fully combusted. An even, well controlled flame anchored at the burner is thereby obtained which can be readily regulated as a function of the heat energy that is required by the kiln. Further, in view of the heating of the pulverized fuel in the burner conventional coal can be mixed with as much as 25% and in some instances as much as 100% by weight of low cost but energy efficient petroleum coke or other waste fuels, depending on the type of coke in question, thereby significantly reducing fuel costs for operating the kiln.

Further, the flow rate of the supplemental air can be readily modulated to control the length, shape and temperature of the flame in the kiln. This flame regulation is significantly facilitated by the fact that the supplemental air constitutes a larger and typically a much larger proportion of the combined primary air. In the presently preferred embodiment the supplemental air volume is as much as 5 to 10 times as large as the coal conveying air volume. Thus, even though the burner operates with as little as 8–10% primary air, and even though a portion thereof (which is not readily changed) is used for conveying the pulverized coal, there is a significant volume of primary air with which the flame can be controlled.

Thirdly, the bulk of the combustion air in the form of secondary air can be of much higher temperature. In a preferred embodiment of the invention, secondary air is taken from the "hood" or cooler surrounding the discharge opening of the kiln which is heated by high temperature product discharged from the kiln to temperatures up to 1650° F. Since the volume of primary air, that is of both the coal conveying air and the heated supplemental air can be maintained relatively low, say 10% of the theoretical air, the bulk of the coal is combusted in a high temperature air stream which not only facilitates a complete combustion of the coal but also assures the desired high flame temperature and a maximum utilization of all available energy. As a result, a kiln firing system constructed in accordance with the invention is substantially more energy efficient than prior art kiln systems.

In a typical example in which a clinker kiln for a cement plant is fired with pulverized coal in accordance with the prior art and with a daily clinker output of 1550 tons, 4.4 MM BTU per ton of clinker is required. By converting to the method of the present invention, the daily output of the kiln can be increased to 1650 tons while the heat input per ton is reduced to 4.1 MM BTU. This constitutes a 6% increase in clinker production while fuel consumption per ton of clinker was decreased by 7%.

In addition thereto, the present invention permits the firing of the burner with a mixture of 75% of relatively low quality coal, that is of coal having a relatively high ash and water content, and 25% or more of low cost petroleum coke. The end result obtained with the present invention are a significant reduction in the operating cost of the plant and thereby in the cost of the end product, e.g. cement, while simultaneously saving increasingly scarce liquid and/or gaseous fuels, Therefore, in a presently preferred embodiment, the present invention contemplates a method for firing a coal burner for a kiln comprising the steps of storing pulverized coal in a container and withdrawing it therefrom at a predetermined rate with corresponds to the deisred rate with which pulverized coal is to be combusted in the kiln. A coal conveying airflow comprising not substantially more than 5% of the theoretical amount of air needed to combust the pulverized coal in the kiln is established and the pulverized coal is entrained therein to form a pulverized coal flow. An amount of supplemental, primary air to establish a coal-airstream having no more than about 20% of the theoretical air is mixed with the pulverized coal flow to establish a coal-airstream. The supplemental primary air is sufficiently heated to vaporize volatiles present in the coal-airstream. Thereafter, the stream is ignited and discharged into the kiln. Sufficient secondary air having a temperature in excess of the heated supplemental primary air is added to the stream in substantially surrounding relationship thereto so as to effect a substantially complete combustion of the pulverized coal in the kiln. In view of the thorough mixing of the secondary air with the pulverized coal discharged into the kiln the burner can be operated with as little as 7% excess air.

Similarly, the present invention provides a method of producing clinker or the like which preferably includes the steps of providing an elongate, longitudinally inclined tubular kiln having a relatively higher intake end a relatively lower discharge opening and introducing clinker raw material into the kiln intake. The kiln is rotated so that the materials travel towards the discharge end. An elongate burner tube is located at the discharge end and oriented substantially parallel to the kiln and has an inner end extending into the kiln and an outer end. A first, pressurized primary airstream is flowed into the outer end of the tube. A second or supplemental flow of primary air, typically having a temperature of at least about 400° F. and preferably of between about 600°-750° F. is formed and the first and second airflows are combined in the vicinity of the tube and directed through the tube. Pulverized coal is entrained in the first airflow at a rate selected so that the complete combustion of the coal in the kiln heats the material in the kiln to the desired temperature.

Further, the flow rate of the first airflow is limited so that the second airflow provides a majority of the combined air flowing through the tube and further so that the combined primary air comprises no more than about 20% and preferably no more than about 10% of the theoretical amount of air required to combust the pulverized coal in the kiln. As a result, the supplemental primary air heats the pulverized coal in the tube sufficiently to vaporize volatiles present in the coal.

Thereafter, the primary air and the entrained pulverized coal are discharged into the kiln from the inner end of the burner tube and secondary combustion air is directed into the kiln through the discharge end of the kiln in substantially fully surrounding relationship to the tube. The amount of secondary air is selected so that sufficient air to fully combust the coal is provided. The secondary air has a temperature substantially in excess of the temperature of the second airflow.

To facilitate the clinker production in general and the start-up of the kiln in particular, and to provide a rapid increase in the generated heat and/or to permit operation of the kiln if and when the coal burner is inoperative, the present invention further contemplates to combine the above described coal burner with a gas or liquid fuel kiln burner of the type disclosed in the commonly owned U.S. Pat. No. 3,918,639. Briefly, that patent provides an arrangement whereby multiple oil or gas nozzles are generally concentrically disposed about the center line of the kiln. The nozzles are constructed so that any one or more of them can be withdrawn for cleaning, maintenance or replacement while the remainder of them continue to fire so as to eliminate the need for periodically shutting down the kiln should burner maintenance or replacement be required.

Since the coal burner of the present invention provides a concentric coal burner tube, it is ideally suited for use in conjunction with the burner disclosed in the above-referenced U.S. patent. Thus, the present invention further is readily adapted for kiln burner installations capable of using separately or simultaneously gaseous, liquid and solid fuels.

In one embodiment of the invention the use of relatively low temperature coal conveying air is eliminated by positioning the pulverized coal bin directly above the burner so that coal can be gravity fed to the burner under the exclusion of conveying air. The necessary temperature in the burner to achieve a vaporization of volatiles in the coal is thereby more easily reached.

From the foregoing, it will be apparent that the present invention also provides a method for heating kilns and the like which not only enables the use of whatever fuel is most economical or available at any given time, but which also assures a continuous and uninterrupted operation of the kiln even when burner maintenance or replacement is necessary. Since the kiln can be in continuous operation large losses from kiln downtimes during burner replacement or maintenance are avoided.

DESCRIPTION OF THE PREFERRED EMBODIMENTS

Figure 1:
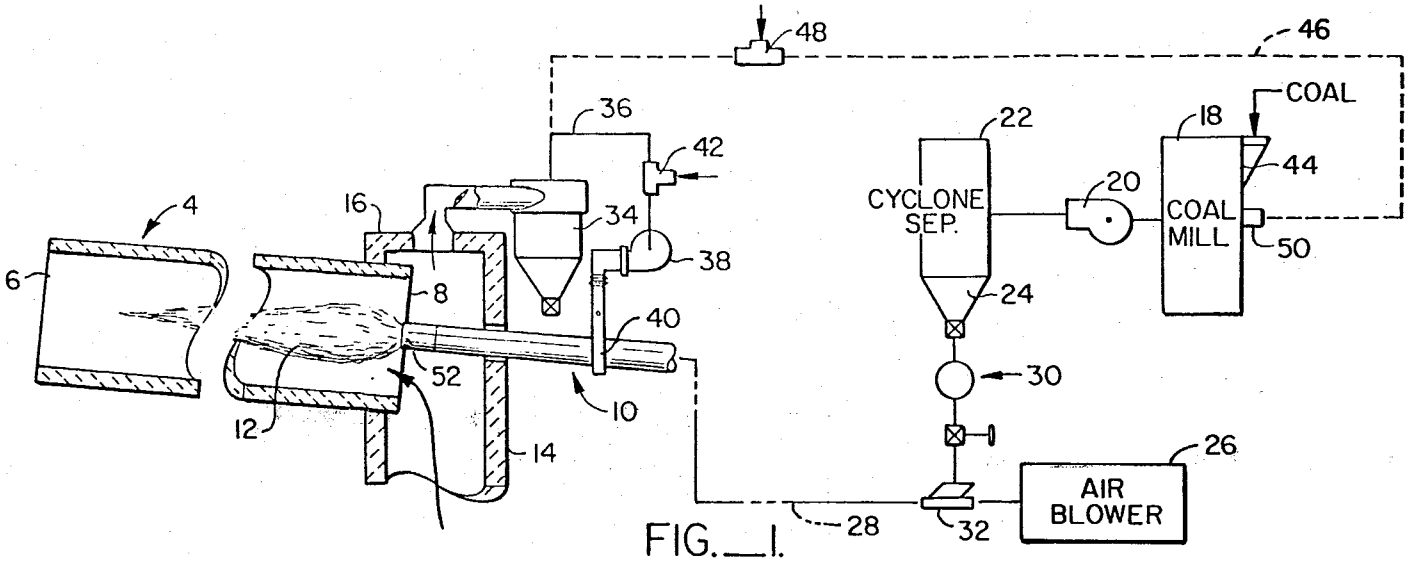
FIG. 1 is a schematic illustration of a kiln provided with a pulverized coal burner which illustrates the manner in which the method of the present invention is performed.

FIG. 1 schematically illustrates a coal preparation, delivery and firing system 2 used in conjunction with a kiln 4 such as a cement kiln. The kiln has a slight angular inclination with respect to the horizontal and includes a relatively higher intake 6 and a relatively lower discharge opening 8. A burner assembly 10 generates a relatively well controlled flame 12 which extends from about the discharge opening into the kiln. In use, the raw materials for the product to be produced in the kiln, for cement clinker usually calcareous and argillaceous and other raw materials, are placed into the intake end of the kiln and gravitate towards the discharge end while the kiln is slowly rotated about its axis. In the kiln, the raw materials are heated to the desired temperature and they are maintained at that temperature for the required time to produce the clinker. Clinker drops through the discharge end of the kiln into a hopper 14 including a hood 16 which cover the discharge end of the kiln for cooling and further processing.

For firing the kiln with pulverized coal in accordance with the present invention, a conventional coal mill 18 pulverizes the coal in the presence of a relatively large amount of air. Pulverized coal and air is withdrawn from the mill by a coal conveying air fan 20 which feeds into a cyclone separator 22 where pulverized coal settles out and is collected in a bottom portion 24 thereof while air delivered into the separator is discharged, typically via a bag house (not shown) or similar filtration device, to the atmosphere.

An air blower 26 generates an airflow which is pressurized to between about 2-15 psi above atmospheric pressure. The air is flowed through a conduit 28 to an upstream end of burner assembly 10, the construction of which will be described in greater detail below. The air blower is dimensioned so that it delivers no more than about 5% and preferably in the range of no more than ½%-2% of the theoretical amount of air needed to fully combust the coal in the kiln.

The bottom end of the cyclone separator constitutes a bin or hopper for pulverized coal which can be withdrawn therefrom via a suitable metering device 30 such as a commercially available rotary air lock feeder (not separately shown) or the like. In operation, the coal is metered out of the bin at the rate required to maintain the kiln at the desired temperature. The withdrawn coal is entrained in the airflow conduit 28 in a suitable mixer, 32. As a result, a primary combustion air-coal flow proceeds from the mixer to the burner assembly 10.

Still referring to FIG. 1, heated supplemental primary combustion air is added to the air-coal flow from conduit 28 in burner assembly 10. The supplemental air is drawn off the top of hood or cooler 16 and thus constitutes air heated by clinker discharged from kiln 4 into hopper 14. The air drawn off the hood is first cleaned in a cyclone separator 34 and then flows via a duct 36 and a fan 38 to a supplemental primary air plenum 40 which introduces the supplemental air into the air-coal flow entering the burner assembly. Since the hot air withdrawn from the hood may reach temperatures in up to 1650° F., which may be too high for use as supplemental primary air and especially for the supplemental air fan 38, a tempering T 42 is provided in duct 36 in the form of a valve with which sufficient ambient air may be added to the hot air in the duct to lower the temperature of the primary air before it is mixed with the coal-airflow in the burner assembly to the desired value.

In regard to the temperature of the supplemental primary air, it is first of all necessary that a sufficient quantity of supplemental air is added to the air-coal flow and that the temperature of the supplemental air is high enough so that the temperature of the combined primary air-coal flow in the burner assembly is such that volatiles present in the coal are vaporized and thus are extracted from the coal as a substantially instantaneously ignitable gas. For practical purposes, the temperature of at least a portion of the pulverized coal in the primary air-coal flow through the burner assembly should be in the range of between about 500° F. to about 1000° F. or more to assure at least a partial vaporization of the volatiles in the coal.

Since the amount of heat that is required to raise the temperature of the coal to that level is directly influenced by the amount of relatively cool primary air used to convey the pulverized coal from bin 24 to the burner assembly, it is desirable to minimize the volume of conveying air. Applicants have determined that coal can be adequately conveyed when the air is pressurized to between about 2 to 15 psi. This yields coal conveying speeds of at least about 4000 and up to 7000 ft. per min. with a conveying air volume that is as little as ½%-2% of the theoretical amount of air needed to combust the coal in the kiln.

Given a ½%-2% conveying airflow for transporting the pulverized coal to the burner assembly and a supplemental primary air temperature of about 600°-750° F., the desired volatization of the coal fines can be reached with a supplemental air volume of about 8% of the theoretical air. The total primary air (conveying air plus supplemental air) ratio can be reduced by correspondingly increasing the temperature of the supplemental air and applicants believe that supplemental air temperatures of as much as 1500° F. or even higher are both possible and desirable from the standpoint of efficiently operating the burner and the kiln. However, it is relatively difficult to handle such high temperature air with presently available equipment; for example, at this time fans capable of handling the required volume of 1500° F. air are not commercially available. If and when such equipment is available, however, the required amount of supplemental air can be reduced proportional to the increase in its temperature. The advantage of such an approach is that more secondary air, which is of even higher temperature as will be further described below, can be employed for firing the kiln burner, thereby increasing the flame temperature and the overall efficiency of the burner.

In operation, coal is introduced into coal mill 18 via a hopper 44 where it is pulverized in the presence of air, preferably hot air taken from cyclone separator 34 and directed via suitable piping 46 and a tempering T 48 (for regulating the temperature of the air) into an air intake 50 of the mill. Air blower 26 is activated and pulverized coal is entrained therein and conveyed to burner assembly 10. Hot, supplemental primary air is mixed in the burner assembly with the coal-airflow received by the burner. The burner includes an elongated burner tube, as is more fully described below, through which the combined primary air (comprising the coal conveying air and the hot supplemental air) and the pulverized coal travel. Within this tube, volatiles in the coal are vaporized. At a downstream end 52 of the burner assembly, the primary air-pulverized coal-vaporized volatile mixture is discharged into the kiln. Secondary combustion air, that is the remainder of the air required to combust the coal in the kiln flows from the hopper through the discharge end 8 into the kiln. The secondary air entirely surrounds the downstream end of the burner assembly and thus assures a uniform distribution of the combustion over the entire cross-section of the kiln to enhance the combustion process.

The secondary air which rises through the hopper 14 is heated by clinker (or any other product processed in the kiln) to a very high temperature, frequently in the range of between about 500°-1650° F. Consequently, the moment the coal-primary air mixture is discharged from the burner assembly, the vaporized volatiles driven off the coal ignite instantaneously, drawing their combustion air from the primary air with which they are intimately mixed. This ignition of the volatiles rapidly raises the temperature of the remaining pulverized coal to its ignition temperature, resulting in a long, readily controlled flame that is anchored to the burner assembly.

In view of the rapid heat release upon the ignition of the vaporized volatiles when the coal-primary air mixture is discharged from the burner assembly, it is further possible to add to the pulverized coal low volatile solid fuels, that is fuels which have no or only a relatively small proportion of volatiles, such as petroleum coke, and which, therefore, are difficult to ignite. Yet, such fuels have excellent heat values and as a result of their ignition difficulties are readily and relatively inexpensively available.

Figure 3:
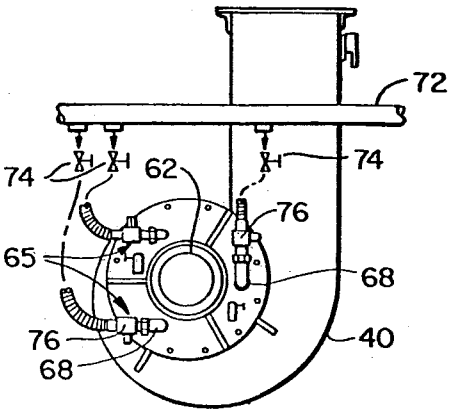
FIG. 3 is a front elevational view of the burner and is taken on line 3—3 of FIG. 2.
Figure 2:
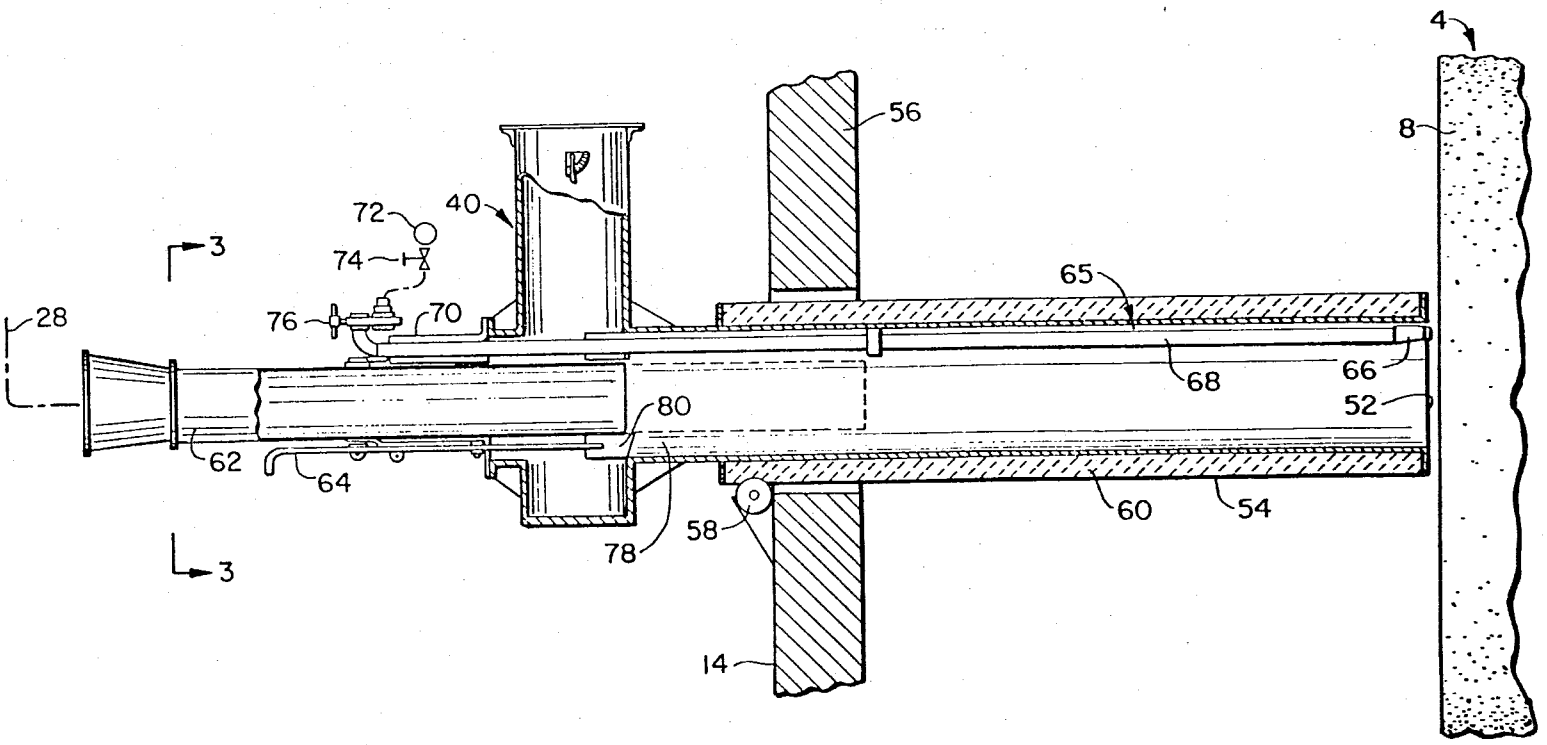
FIG. 2 is a fragmentary, enlarged side elevational view, in section, and illustrates the coal burner used for practising the present invention in greater detail.

Referring now to FIGS. 1-3, the actual construction of the burner assembly will be described in greater detail. Principally, the burner assembly comprises a mixing tube which extends from the supplemental air plenum 40 through a wall 54 of kiln hood-cooler transition 14 and terminates in downstream end 52 which is approximately aligned with the discharge opening 8 of kiln 4. The tube is preferably mounted on rollers 58 to permit its withdrawal out of the hood, that is to the left as shown in FIG. 2 for cleaning, maintenance, etc. The portion of the mixing tube protruding into the hood is coated with refractory material 60 for protecting it against the intense heat prevailing in the hood and the kiln.

A coal supply pipe 62 receives the coal-airflow from conduit 28 and has a substantially lesser diameter than the inner diameter of the mixing tube to define an annular space 78 therebetween. It is mounted so that it can be axially moved from a fully retracted position, as shown in solid lines in FIG. 2, to a fully inserted position shown in dotted lines. A handle 64 is used to position the cool/air mixer device 80 used to control the rate of hot air/coal mixing.

The burner assembly also includes an auxiliary oil and/or gas burner 65 defined, for example, by three nozzles 66 (only one is shown in FIG. 2) which are connected to elongate, rearwardly (to the left as seen in FIG. 2) extending oil or gas pipes 68 which extend concentrically with coal pipe 62 through annular space 78 past the supplemental air plenum 40 to the exterior thereof. Suitable packing 70 is provided where the gas pipe protrudes from the supplemental air plenum 40 so as to prevent the escape of air from the plenum and the mixing pipe to the exterior thereof. The ends of the gas pipes are fluidly connected to a gas or oil supply manifold 72 via shutoff valves 74. For oil operation of the auxiliary burner and an air blowdown valve and supply system 76 is provided for purging oil from pipes 68 and nozzles 66 when they are not in use. Further, the nozzles and oil/gas supply pipes are axially retractable from the mixing tube 54 for maintenance, cleaning, etc. Additional details of the construction of the auxiliary burner 65 are set forth in U.S. Pat. No. 3,918,639.

In operation, hot supplemental primary air enters through plenum 40 into the annular space 78 between the exterior of the coal supply pipe 62 and the interior of mixing tube 54 and propagates downstream towards kiln 4. The air-pulverized coal flow from conduit 28 passes through coal supply tube 62 and into the center portion of the mixing tube 54 where the coal is surrounded by the hot supplemental primary air and is mixed therewith. Mixing can be enhanced by providing appropriately shaped, oriented and positioned vanes (not separately shown) to promote intimate contact between the hot supplemental air and the coal particles. From the downstream end 80 of the coal supply tube to the downstream end 52 of the mixing tube, the hot supplemental air heats the coal. The effective length of the mixing tube is selected by appropriately inserting or retracting coal pipe 62 so that the stay time of the coal in the tube is sufficient to vaporize volatiles in the coal before the combined primary aircoal mixture is discharged into the kiln and ignited. The stay time is varied by adjusting the axial position of the coal supply pipe to take into account variations in the air and coal flow rates, the temperature and volume of the supplemental airflow, temperature conditions in the kiln, etc.

The efficient and complete combustion of pulverized coal in the kiln requires the presence of relatively high temperatures. During initial start-up, especially when the kiln is relatively cool, temperatures are frequently insufficient for firing the pulverized coal. At such times, it is preferred to temporarily fire the auxiliary burner 65 to raise the kiln temperature to a level where coal firing is feasible. Simiarly, during periods of exceptionally high heat requirements in the kiln, or when the coal burner must be shut down for maintenance or the like, the kiln firing can continue with the auxiliary burner. In this regard, it should also be noted that the concentric distribution of the oil/gas nozzles 66 about the pulverized coal-primary air-stream discharged into the kiln facilitates the ignition of the coal particles in the hot environment of the burning oil or gas and thus hastens the time when, during initial start-up, for example, coal firing can commence so as to minimize the use of the relatively more expensive fluid fuels.

Figure 4:
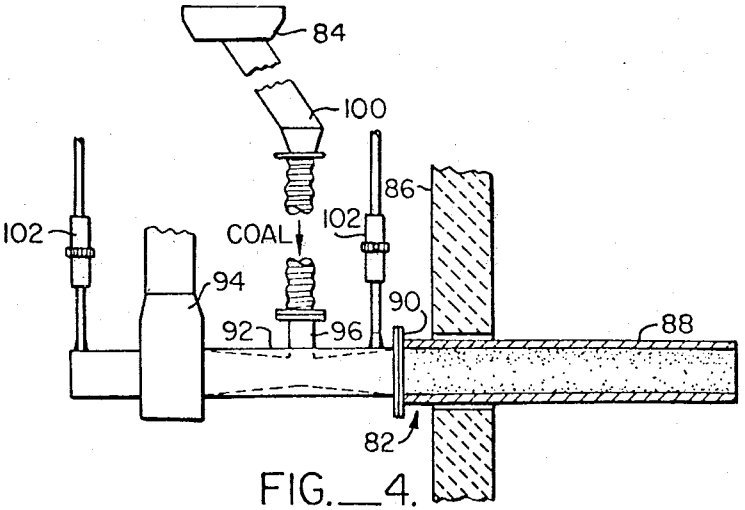
FIG. 4 is a schematic illustration of using a gravity feed for supplying pulverized coal to the burner.

Referring briefly to FIG. 4, in an embodiment of the invention particularly adapted for use in installations where there is ample overhead space above a coal burner 82, pulverized coal is gravity fed to the burner without (relatively cool) conveying air by providing a coal bin 84 disposed above the burner and exteriorly of a kiln cooler 86. The burner again has a discharge tube 88 which projects into the kiln (not separately shown in FIG. 4). An upstream end 90 of the tube is disposed exteriorly of the kiln cooler and connected to a venturi mixer 92, the upstream end of which receives heated primary air from a primary air plenum 94. As before, the primary air has a sufficient temperature so that it causes the vaporization of volatiles in the pulverized coal when mixed therewith.

The venturi mixer includes an upwardly directed coal intake 96 which is coupled with pulverized coal bin 84 via a flexible hose 98 and a flow stabilizing chute 100. A pair of hangers 102 support the discharge tube and the plenum from a suitable overhead structure (not shown).

In use, heated primary air having a temperature of preferably between 600°–750° or more flows from the plenum through venturi mixer 92 into the discharge tube 88. Coal is gravity fed at the required rate from the bin via the chute and the flexible hose into the venturi mixer where it is entrained in the primary airflow and carried through the tube into the kiln. Heat from the primary air raises the temperature of at least a portion of the coal sufficiently in the above stated manner so that volatiles are evaporated to facilitate the ignition upon discharge of the coal-primary airflow from the burner.

We claim:

1. A method for firing a coal burner for a kiln comprising the steps of: providing pulverized coal at a predetermined rate which corresponds to the desired rate with which pulverized coal is combusted in the kiln; pneumatically transporting the pulverized coal to the burner with an amount of primary combustion air of at most about 5% of the theoretical amount of air needed to combust the pulverized coal; forming a supplemental primary combustion airflow measured so that the primary combustion airflow and the supplemental primary combustion airflow comprise at most about 20% of the theoretical amount of air needed to combust the pulverized coal; heating the supplemental primary air to a temperature of at least about 600° F.; combining the primary combustion airflow and the pulverized coal entrained therein with the supplemental primary combustion airflow to form a coal-airstream at the burner; flowing the coal-airstream over a sufficient distance so that volatiles in the pulverized coal in the stream are driven off; thereafter igniting the coal-airstream to form a flame directed into the kiln; generating a secondary combustion airstream for providing the balance of combustion air required for fully combusting the pulverized coal in the stream; heating the secondary combustion air with product discharged from the kiln to a temperature of at least about 800° F.; and mixing the secondary combustion air with pulverized coal discharged into the kiln to effect the full combustion of the pulverized coal.

2. A method for firing a coal burner for a kiln comprising the steps of: providing pulverized coal; establishing an airflow of not substantially more than 5% of the theoretical amount of air needed to combust the pulverized coal in the kiln; entraining pulverized coal in the airflow at a predetermined rate which corresponds to the desired rate with which pulverized coal is combusted in the kiln to thereby form a pulverized coal flow; mixing the coal flow with an amount of supplemental, primary air to establish a coal-airstream having no more than about 20% of the theoretical amount of air needed to combust the pulverized coal in the kiln; directing the coal-airstream through a burner tube; heating the supplemental primary air to a sufficient temperature and retaining the coal-airstream in the burner tube for a sufficient length of time to vaporize in the coal-airstream volatiles present in the coal; thereafter discharging the stream from the burner tube into the kiln; igniting the stream; and introducing sufficient secondary air having a temperature of at least about 800° F. into the kiln and in substantially surrounding relationship to the stream discharged into the kiln so as to substantially completely combust the pulverized coal in the kiln.

3. A method according to claim 2 including the step of controlling the amount of air in the coal-airstream so that the stream comprises no more than about 10% of the theoretical amount of air needed to combust the pulverized coal.

4. A method according to claim 2 wherein the heating step comprises the step of heating the supplemental primary air to a temperature range of between about 600°-1500° F.

5. A method according to claim 2 wherein the secondary combustion air has a temperature in the range of between about 800° F. to about 1650° F.

6. A method according to claim 5 including the step of heating the secondary combustion air with product fired in the kiln.

7. A method according to claim 2 wherein the step of entraining includes the step of gravitationally moving the pulverized coal to the airflow.

8. A method according to claim 2 wherein the supplemental primary air mixed with the coal flow comprises no more than about 8% of the theoretical amount of air needed to combust the pulverized coal.

9. A method according to claim 2 wherein the step of establishing includes the step of pressurizing the air to at least about 2 psi above the pressure prevailing in the kiln.

10. A method according to claim 8 wherein the step of pressurizing comprises the step of pressurizing the air to a range of between about 2 to about 15 psi above the pressure prevailing in the kiln.

11. A method according to claim 2 wherein the step of establishing includes the step of pressurizing the air sufficiently so that the pulverized coal flow travels at a speed of at least about 4000 ft. per minute.

12. A method according to claim 2 including the step of including in the pulverized coal flow up to about 100% of a material comprising essentially carbon.

13. A method according to claim 12 wherein the material comprises petroleum coke.

14. A method according to claim 13 wherein petroleum coke is included in the pulverized coal flow in an amount of no more than about 25% by weight.

15. A method according to claim 2 wherein the step of establishing comprises the step of establishing an airflow of not substantially more than about 2% of the theoretical amount of air needed to combust the coal.

* * * * *